US006517373B2

(12) United States Patent
Finke et al.

(10) Patent No.: US 6,517,373 B2
(45) Date of Patent: Feb. 11, 2003

(54) CIRCULAR CONNECTOR

(75) Inventors: Hans Michael Finke, Elztal-Auerbach (DE); Dieter Fink, Rosenberg (DE)

(73) Assignee: Franz Binder GmbH & Co. Elektrische Bauelemente KG, Neckarsulm (DE)

( * ) Notice: Subject to any disclaimer, the term of this patent is extended or adjusted under 35 U.S.C. 154(b) by 0 days.

(21) Appl. No.: 09/842,589

(22) Filed: Apr. 26, 2001

(65) Prior Publication Data

US 2002/0019161 A1 Feb. 14, 2002

(30) Foreign Application Priority Data

May 2, 2000 (DE) ..... 100 21 377

(51) Int. Cl.[7] ..... H01R 13/627
(52) U.S. Cl. ..... 439/352; 439/353
(58) Field of Search ..... 439/352, 353, 439/357, 358, 354, 271

(56) References Cited

U.S. PATENT DOCUMENTS 4,545,633 A * 10/1985 McGeary ..... 439/141
4,548,455 A 10/1985 Ezure ..... 439/152
5,176,533 A * 1/1993 Sakurai et al. ..... 439/352
5,498,171 A 3/1996 Semaan ..... 439/352
5,637,010 A * 6/1997 Jost et al. ..... 439/352
5,746,619 A * 5/1998 Harting et al. ..... 439/352
5,807,129 A * 9/1998 Konda et al. ..... 439/348
6,093,043 A * 7/2000 Gray et al. ..... 439/352

FOREIGN PATENT DOCUMENTS

DE 3111073 A1 2/1982
DE 4325895 C1 12/1994

* cited by examiner

*Primary Examiner*—Gary Paumen
*Assistant Examiner*—Ann McCamey
(74) *Attorney, Agent, or Firm*—Koda & Androlia

(57) ABSTRACT

In a connector, a first connector element, in particular a plug, and a second connector element, in particular a socket or a housing adapter, have a first or second contact insets around the first contact inset of a plug, and a sleeve-shaped latch segment is arranged from which, running along the longitudinal direction of the connector, resilient latch flanges with latch tabs are formed that are appropriate for locking onto a ring-shaped groove formed on the inner side of the second connector element (locking position). The plug includes an outer sleeve-shaped actuation slid, which can be slid back against the spring force along the longitudinal direction of the connector (unlocking position) and is appropriate for actuating one or more unlocking elements, which can be slid along the longitudinal direction of the connector under a section of the latch flanges and are appropriate for supporting the latch flanges (locking position).

11 Claims, 4 Drawing Sheets

CIRCULAR CONNECTOR

BACKGROUND OF THE INVENTION

1. Field of Invention

The invention relates to a circular connector and more particularly to a circular connector comprising a first connector element that is specifically a plug and a second connector element that is specifically a socket or a housing adapter.

2. Prior Art

Such circular connectors are preferably designed in such a way that, to connect together and latch the two connector elements that make up the connector, the connector needs only to be inserted along the direction of the longitudinal axis of the connector with no additional motions and no enclosure being required for locking. The connector should have automatic, spring-actuated locking. By pulling on an actuation element of the plug, the locking should release itself automatically. Thus, to unlatch and release the circular connection, no further motion should be required that is not along the longitudinal or principal direction. In addition, the same actuation element should serve for unlocking on releasing the circular connection as well as for locking on insertion.

These requirements are met by a plug known in the art, which, together with a socket, forms a circular connection and has a tube-shaped inset that surrounds the contact inset, in which in one embodiment, latch flanges are stamped out of the metallic, tube-shaped inset directed along the longitudinal direction of the plug (U.S. Pat. No. 4,548,455). Each one of the latch flanges is surrounded by a U-shaped slit in such a way that the free end of the latch flange, each of which is near the open end of the plug, has an elastic radial motion while the other, opposing end of the latch flange melds into the tube-shaped inset. On one side of the latch flanges at their free ends, shaped, beveled latch tabs of the latch flanges hook into a circumferential groove behind a rim or lip of a recess on the outer side of the second connector element, a socket, when the plug is inserted in it. To lock this latch flange, a support is used that lays against the side of the latch flange opposite from the latch tab and can slide along this side in the longitudinal direction of the plug. Each support has a free, radially elastic end, which is directed toward the free end of the plug, and on its opposite end is firmly attached to a ring element or formed as a single piece with it. The supports, which can also be designated as braces, run approximately over the length of the latch flanges. The supports are normally pushed by a coil spring, which is supported between the ring element and a cap of the plug, up to the free end of the latch flanges so as to end essentially there. They can be pulled back in the opposing direction against the force of the spring in order to release a latched plug connection. For this purpose, two radial tabs on the ring element are used, which are pushed by means of a coil spring against a ring-shaped cutout in an actuation slide, which is thereby pressed forward. Then during the process of plugging in, the latch flanges can be inserted into the groove behind the ring-shaped recess on the front side of the second circular connection element in that the latch flanges, as a result of their beveled tabs, bend the end of the supports downward to the extent that the supports are stopped at the front side of the second connector teams and are not brought further along by the motion of insertion until the latch tabs of the latch flanges lie completely within the groove and the latch flanges leave the ring-shaped recess free to receive the supports. The supports are pushed so far forward by the force of the spring to the free end of the latch flanges that these are effectively supported in the ring-shaped recess and thereby locked. The latch flanges can only be extracted from the groove behind the ring-shaped recess when, by a pull on the actuation slide, the supports are withdrawn from the ring-shaped opening against the force of the spring.

With this known circular connector, the goals of simple operation for locking and unlocking mentioned in the introduction are indeed achieved but with a relatively complicated, multipart constructive design of the connector requiring an appreciably costly production and assembly. An essential complication arises in that the supports have a motion opposite to that of the actuation slide in the locking procedure, that is to say, must be carried out in a two-stage process, and has to be held back to achieve the desired relative motion.

In another circular connector known in the art, the plug consists of a contact pin, a cylindrical isolation bushing and a locking sleeve, which can slide along the isolation bushing but is not spring loaded (DE 31 11 073 A1). The contact pin is held in the isolation bushing whose one end is cut out into elastic brackets having ring-shaped bulges near their centers. The brackets extend out through openings in a shoulder of the locking sleeve. The latter has a neck with a bulge facing radially outward that can fit into a ring-shaped groove formed on the inside of the brackets. Before establishing a contact between a socket contact in a drill hole of an isolation housing and the contact pin of the plug, the locking sleeve of the plug is pulled back so that its shoulder touches the beginning of the brackets. The ends of the brackets are left free and extend radially outward. They are inserted into the socket contact while being bent inward so that, eventually, the bulges of the brackets latch into a ring-shaped groove in the drill hole of the isolation housing. In this position of the brackets, they are locked when the locking sleeve is slid forward and its neck is pushed under the brackets and the bulges of the neck snap into the recess of the brackets so that these can no longer be simply pulled out of the latched position. To accomplish this, the locking sleeve must first be pulled out using an extraction tool and the brackets with their bulges can again be elastically unlatched from the groove and the plug can be removed. Therefore, before establishing a contact and to release a contact, a separate relative positioning of the locking sleeve and the bushing must be precisely established and maintained and, only to lock the latched contacts, must the locking sleeve be slid into another position, the locking position. Before and after the brackets are inserted into the drill hole in front of the circular connection contact, they are splayed radially outward, can easily here be accidentally bent further outward and possibly damage but even under standard operation require care on insertion in the drill hole in front of the circular connection contact. Material fatigue can also occur from the bending process under standard procedure. Apart from that, the circular connector known in the art is hardly appropriate for shielded embodiments and sealed protection.

Part of the further state of the art is a connector pair with a plug and a socket, each with a contact inset and a housing, for which, in the area of the free end of the one housing there are one or more indentations on its outer wall and in the area of the free end of the other housing one or more engaging elements corresponding with the indentation are arranged, which, in a first position, project into the cavity of the other housing and, in a second position, release the cavity of the other housing (DE 43 25 895 C1). A sleeve surrounding the free end of the other housing in a rest position forces the engaging element into the cavity of the other housing and in an actuation position allows the engaging element to be released from the cavity of the other housing. Preferably, three engaging elements are staggered around the circumference. Each engaging element has a relatively complicated profile with a three-legged, open angular form. During assembly, they must each be individually placed in an opening in the other housing and held there until the sleeve is slid over the engaging elements. The profile and the opening, which receives both the second and the third legs of the engaging element with play and in which the engaging element can spring along the radial direction, require a considerably large clearance which sets limits on miniaturization of the connector pair.

In another non-generic connector, an extended resilient lock arm, which extends along the plugging direction and is flexibly connected on both of his ends with the first connector element, is formed from a first connector element (U.S. Pat. No. 5,498,171). It has tabs on its upper side that can lock into an opening of the wall section of a second connector element and thereby secure the circular connection. By pressing down on the tabs, the circular connection can be easily separated. Under the lock arm, an additional flat locking element can be slid in perpendicular to the plug connection by which the force necessary to separate the circular connection is increased considerably. However, the requirement mentioned in the introduction, according to which no further motions are required along the longitudinal or main axis direction, where the main axis direction is normally the direction of insertion.

SUMMARY OF THE INVENTION

Therefore, it is an object of the present invention to create an uncomplicated circular connector of the kind mentioned in the introduction with few, easy-to-produce elements that can be easily assembled and at the same time fulfill the stated requirements for connectors.

This task is solved by the design of the circular connector with the characteristics presented in Claim 1.

This circular connector is compactly designed with a one-piece latch segment with integrated spring elements, namely the specially arranged latch flanges, and therefore without separate spring elements. Of particular advantage here is the one-piece design of the actuation slide with one or more sliding supports as locking element. A bearing need not be provided along the directions of the relative motion of the sliding support with respect to the actuation slide.

The essential point is that the latch flange of the latch segment, in every position of the connector with the exception of unlocking, has its free and near the actuation slide lying atop the sliding support extending out from the slide. However, the latch flange, except for its free end is, not supported by the latch element over its length up to the point where it melds as a single piece into the latch segment.

In combination with this, preferably in accordance with Claim 2, the latch tab is formed on the latch flange at a distance from its free end and specifically on the side facing opposite from the support point on the sliding support. In this way, it is achieved that, upon insertion of the plug, the latch flange with its latch tab is pressed radially inward from its rest position whenever it passes over the rim of the ring-shaped groove formed on the inner side of the other element, the housing adapter. Afterwards, the latch tab engages into the groove and the latch flange expands. The important point is that, during the action of plugging in, except for the rather moderate radial excursion of the latch flange, no further element moves. With the expansion of the latch flange in the locked position, just as in the unplugged state of the plug, practically no material fatigue of the latch flange is to be expected.

The locking force to be overcome if the locked connector were to be released without unlocking is dependent upon the angle and position of the latch tab. Because of the elastic flexibility of the latch flange in the region of the latch tab, depending on the shaping of the angle of the latch tab, either no unlocking is possible without removal of the sliding support, when the angle is approximately 90°, or a release of the circular connection would be possible under a specific force with a smaller angle of the beveling of the latch tab. The latter has the advantage that the plug can release itself under a sudden pulling force, for example if someone accidentally stumbles over one of the cables connected with the connector.

In order to unlatch the circular connection, using the actuation slide, the sliding support connected to it is drawn away from under the free end of the latch flanges so that these can easily bend radially inward with a pull on the plug when the latch tabs come to be under the rim of the circumferential groove in the other circular connection element. The expenditure of force for releasing the plug connection with simultaneous unlocking is therefore small. After release of the actuation slide, it will move back, under the force of the spring, into its original position in which the sliding support finds itself under the free end of the latch flanges, which are not however subjected to stress.

Preferably, the sliding support consists of supports in the shape of cylinder segments, which are formed from a ring-shaped, radially inward front face of the actuation slide. In this way, a support in the shape of a cylinder segment can serve to support the free end of one or more latch flanges. This allows the actuation slide with sliding support to have a compact design.

It is particularly advantageous, as in Claim 4, to have the free ends of the latch flanges arranged so they can move radially within an enveloping ring, which is formed from the latch segment on its side facing the actuation slide. In this way, the free ends of the latch flanges are covered from the outside by the enveloping ring so that they cannot be damaged or splayed.

In an aesthetically particularly appropriate embodiment of the connector according to Claim 5, the ring of the latch segment has the same outer diameter as the adjacent outer face of the actuation slide with which it thereby smoothly abuts.

The latch segment is quite suitable, in accordance with Claim 6, to being spray-coated with paint as color-coding, which allows making the arrangement of the plug obvious. In this way, the color-coding is also recognizable in the plugged-in position.

According to Claim 7, the latch segment can be produced as an easy-to-manufacture plastic piece.

In this case, as in Claim 8, easy-to-manufacture grooves can be formed along the longitudinal direction in the latch segment into which coding pins of varying number and varying geometric designs can be inserted. In this way, the user will have the ability, according to use or need, to fit the connector with snap-in coding pins in the grooves. The technical expense for tools utilized in the production of the latch segment is likewise relatively small.

In a particularly advantageous manner according to Claim 9, the connector, as a combination element, has a single-piece base shell, which tightly encloses the first contact inset of the plug, the latch segment is arranged on the free outer section of the base shell and the actuation slide is located after the latch segment along the longitudinal direction enclosing a spring between one inner facet of the actuation slide and an encompassing cylindrical tab of the base shell. With this compact connector, the user can easily carry out a plug installation without having to disassemble or assemble the individual components of this circular connection element. In addition, a simple angle plug arrangement can be created with this circular connection element since an angled housing can be flange mounted on these. Furthermore, the single-piece plug shell enables a simple sealing of the first contact inset.

According to Claim 10, the single-piece base shell consists advantageously of metal in order to shield the first contact inset of the plug. Further measures to ensure a sufficient contact between several shielding parts are not needed. By using a support shell of metal, other components of the connector element, such as latch segments and actuation slides, can, if necessary, be made of plastic, even for shielded versions of this connector element. The production of the locking element is thus not differentiated according to shielded or unshielded version, from which a simplified production results with the use of plastic-specific advantages as well as a reduced logistic effort.

The secure sealing of the connector element with plug shell is carried out advantageously in accordance with Claim 11 in that the plug shell is sealed on its inner end in the plug with a first O-ring lying in a ring groove in the first contact inset and is sealed on its outer end, which extends out of the latch segment, with a second O-ring lying in a circumferential groove of the housing adapter.

BRIEF DESCRIPTION OF THE DRAWINGS

The invention is illustrated in the following using a drawing with four figures in which a connector consisting of a plug and housing adapter is presented in enlargement and with partial sectioning along the longitudinal axis. Further advantageous characteristics are demonstrated from these, wherein.

DETAILED DESCRIPTION OF THE INVENTION

Figure 1:
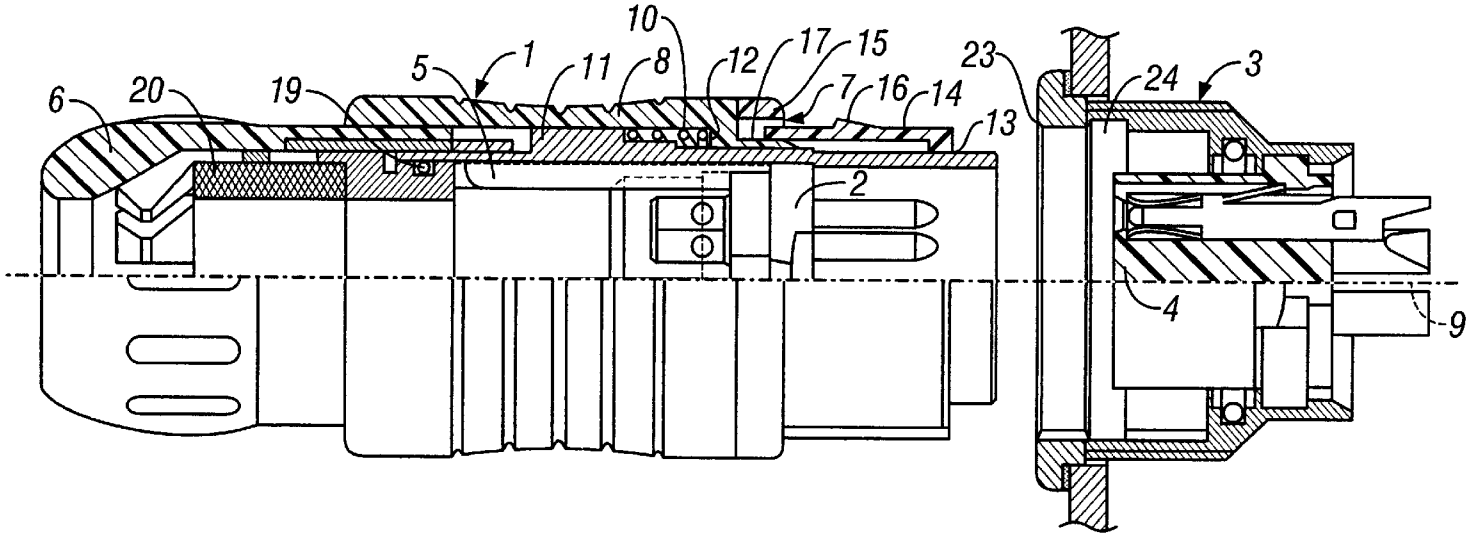
FIG. 1 shows the plug in unplugged condition.
Figure 1A:
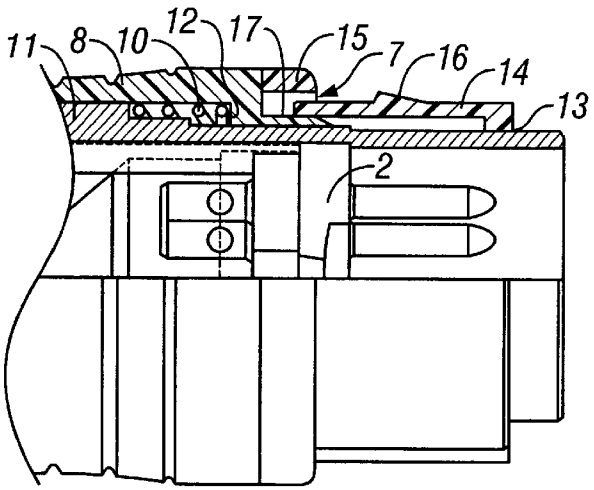
FIG. 1*a* shows a section of the plug according to FIG. 1, in enlarged presentation and with partially changed hatching.

In the drawings, the plug, which includes a first contact inset (2), is designated in its entirety by (1). A housing adapter of standard design, which contains a second contact inset (4), is designated in its entirety by (3).

The plug is built with a single-piece metal base shell which, on its cable end, has a pressure screw (6) for securing and sealing the cable is screwed and, on its opposite, free end, has a latch segment designated generally by (7). An actuation slide (8) with an undesignated recessed grip is located essentially between the pressure screw (6) and the latch segment (7) on the base shell (5) so that it can slide in the longitudinal direction, i.e. along the direction of the principal axis (9). It is forced by a spring (10) acting as pressure spring between a circumferential, cylindrical tab (11) of the base shell and an inner face (12) of the actuation slide (8) toward the right to the position shown in FIGS. 1, 2 and 3 as long as it is not moved back against the force of the spring (10) by pulling on the plug as in FIG. 4.

The latch segment (7) is approximately cylindrical shaped. With a ring-shaped shoulder on the front it fits closely to the base shell (13). Connected to the shoulder (13), several latch flanges, of which one latch flange (14) can be seen in the Figures, are formed from the essentially cylindrical latch segment by slits running along the longitudinal direction. The latch flange juts out with an undesignated free end under a surrounding ring (15), which is likewise formed as a single piece from the latch segment (7), in such a way that the latch flanges can be bent outwards within the surrounding rings. On each one of the latch flanges (14), a latch tab (16) is formed facing outward at a distance from the free end and from the shoulder (13).

Figure 2:
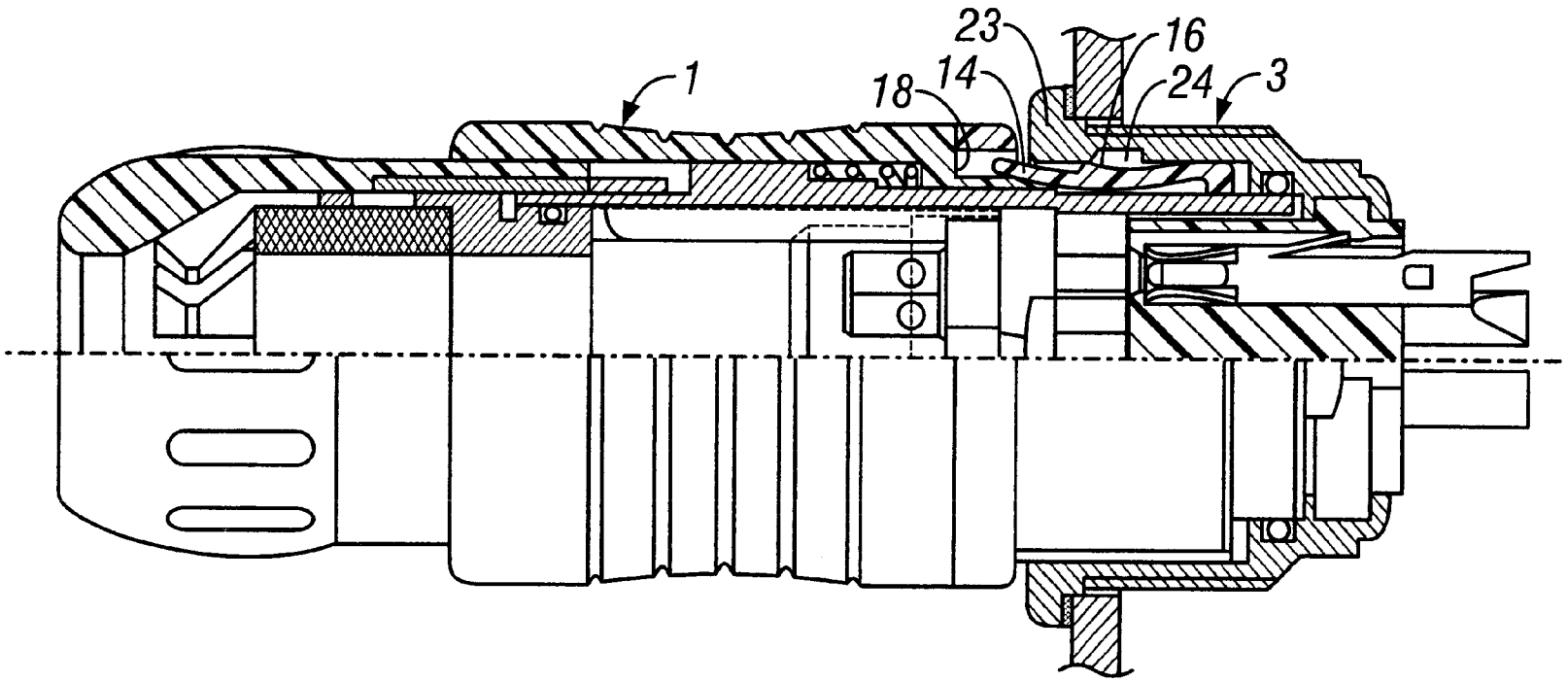
FIG. 2 shows the plug while being plugged into the housing adapter.
Figure 3:
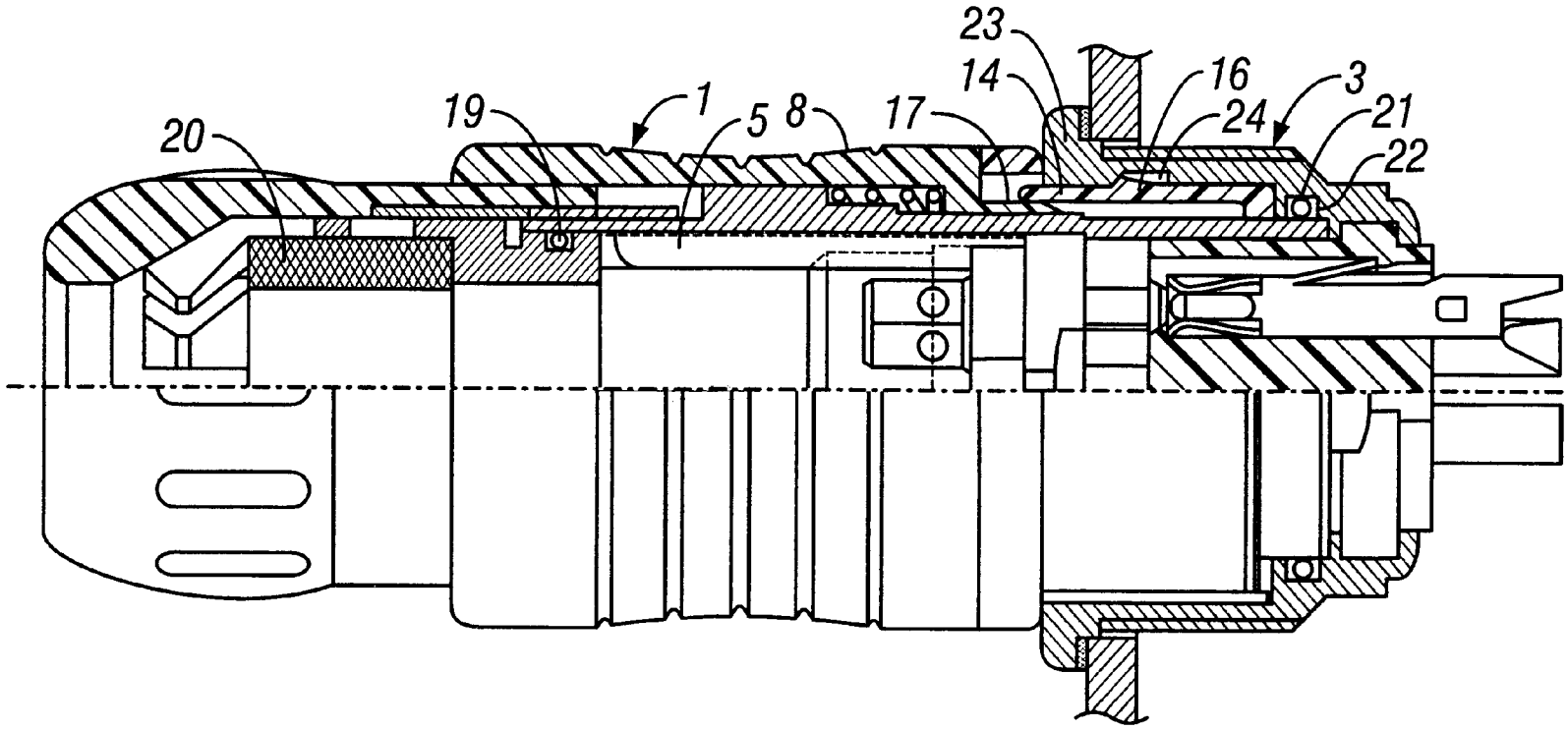
FIG. 3 shows the plug in plugged-in condition.

As can be seen in FIGS. 1 through 3, the free end of the latch flange sits atop a sliding support (17) and a series of several supports around the perimeter can be designated, in their entirety, as the sliding support, which is formed from a ring-shaped inner face (18) of the actuation slide (8) so that is makes a sliding connection with the base shell (5). In its entirety, the sliding support has approximately the form of a hollow cylinder.

The latch segment (7) is made of a plastic that gives the latch flanges, which are formed as a single piece with the latch segment, sufficient elasticity in the radial direction.

As can be seen in particular in FIG. 1, the base shell, after assembly of the latch segment (7) and the slide (8) with the enclosed spring (10), forms a self-contained mechanism.

As especially FIG. 3 shows, the interior of the connector is sealed, in particular within the support shell (5), by an inner first O-ring (19) as well as a seal (20) in the cable lead and is sealed on an opposite end within the housing adapter (3) by a second O-ring (21) that lies in a circumferential groove (22) of the housing adapter and presses against the outer free end of the base shell (5), which projects to within the housing adapter (5).

In the following, the locking process is presented:

In the unplugged state of the plug, as in FIG. 1, the latch flanges (14), which form a one-piece connection with the latch segment on one side, have their free ends resting on the sliding supports (17) on the front side (18) of the actuation slide (8). They are unstressed and therefore not bent.

While the plug (1) is being inserted into the housing adapter (3), as in FIG. 2, a rim (23) of a groove (24) circumscribed within the housing adapter (3) slide over the latch flanges (14), which are pressed inward from their rest position against the elasticity of the latch flanges to the extent that the latch tabs (16) fit under the rim (13). During this process, no other part of the connector moves.

As soon as the plug (1), as in FIG. 3, has been completely inserted into the housing adapter (3), the latch tabs (16) lie entirely within the groove (24) whereby the latch flanges (14) being once again unstressed. At the same time, the forward, free ends of the latch flanges (14) sit, as before, atop the sliding supports (17) of the actuation slide (8). If a pulling force then occurs between the plug (1) and the housing adapter (3) that is not applied to the actuation slide (8), the latch tabs of the latch flanges (14) can then only slide out of the circumferential groove (24) if each of the latch flanges are bent radially inward by a force component induced on it by the beveled surfaces of the circumferential groove (24) and the latch tab (16). The pulling forces necessary for this are a function of the angles of inclination of the latch tabs (16) and the side of the groove (24) opposing them. In other words: by the dimensioning of these angles, the pulling impulse required for releasing the plug from the housing adapter without actuation of the actuation slide (8) can be determined.

Figure 4:
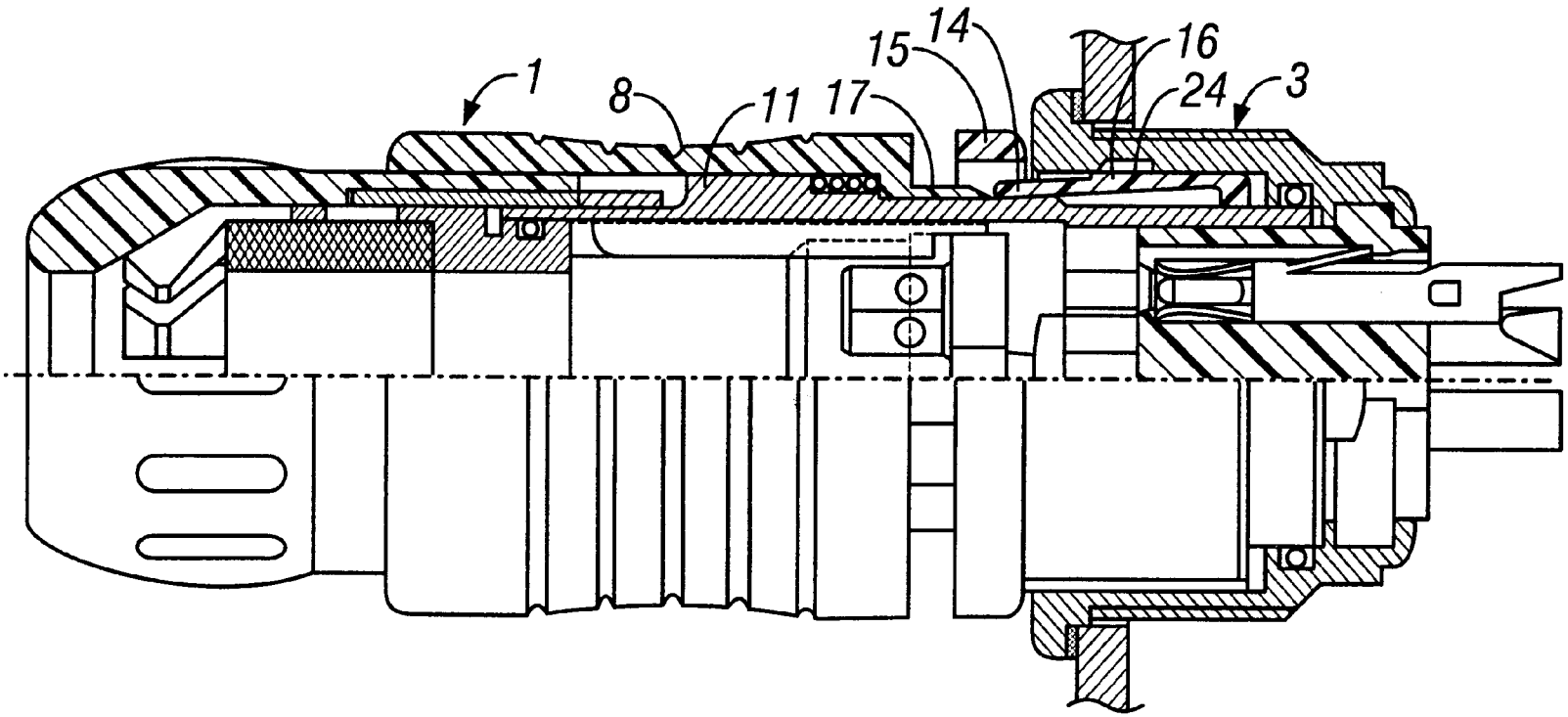
FIG. 4 shows the plug while being unplugged.

In a normal unlocking procedure, while pulling on the plug, the actuation slide (8) is held, as in FIG. 4, so that this can be pulled back against the force of the spring (10). The sliding supports (17), which served as support for the free ends of the latch flanges (14), slide out from under these so that the latch flanges can now be pulled out of the housing adapter (3) easily and without overcoming great resistance while they are being pushed downward by the latch tabs (16) on the circumferential rim (23) of the housing adapter. When the plug (1) is completely extracted in this way from the housing adapter (3), it again assumes the form presented in FIG. 1.

What is claimed is:

1. A circular connector with a first connector element and a second connector element that each have a first (2) or respectively second contact inset (4) in which, around the first contact inset (2) of the first connector element, a sleeve-shaped latch segment (7) is arranged from which, running along the longitudinal direction of the connector, one or more resilient latch flanges (14) with latch tabs (16) are formed that are appropriate for locking onto a ring-shaped groove (24) formed on the inner side of the second connector element (locking position) and in which the first connector element includes an outer directly manually operated sleeve-shaped actuation slide (8), which can be slid back against a spring force along the longitudinal direction of the connector (unlocking position) and is adapted to actuate one or more sliding supports (17) as locking elements, which can be slid along the longitudinal direction of the connector under a section of the latch flanges (14) and are appropriate for supporting the latch flanges (14) (locking position), characterized in that the latch flanges (14) formed from the latch segment (7) are integrally fixed to an end thereof in a manner ending rearwardly toward the actuation slide (8), that the sliding supports (17) are formed from an end of the actuation slide (8) and are directed directly toward the free ends of the latch segments (7), wherein the sliding supports (17) extend from outside of the latch flanges (14) essentially beneath their free ends only, when the actuation slide (8) is pushed forward under the force of the spring (10).

2. The connector according to claim 1, characterized in that the latch tab (16) is formed from the latch flanges (14) at a distance from its free end.

3. The connector according to claim 1 or 2, characterized in that the sliding support consists of sliding supports (17) in the shape of cylinder segments formed from a ring-shaped, radially inward facing side of the actuation slide (8).

4. The connector according to claim 1, characterized in that the free ends of the latch flanges (14) are arranged allowing radial movement within a surrounding rim (15), which is formed from the latch segment (7) on its side facing toward the actuation slide (8).

5. The connector according to claim 4, characterized in that the surrounding rim (15) of the latch segment (7) has the same outer diameter as the actuation slide (8) and abuts smoothly with it.

6. The connector according to claim 4 or 5, characterized in that the latch segment (7) is spray-painted with color as color-coding.

7. The connector according to claim 1, 2, 4 or 5, characterized in that the latch segment (7) is made of plastic.

8. The connector according to claim 7, characterized in that grooves into which coding pins can be inserted are formed in the latch segment (7) along its longitudinal direction.

9. The connector according to claim 1, characterized in that a one-piece base shell (5) tightly encloses the first contact inset (2) of the first connector element, that the latch segment (7) is firmly attached on a free, outer section of the base shell (5) and that the actuation slide (8), which encloses a spring (10) between an inner face (12) of the actuation slide (8) and the circumferential, cylindrical tab (11) of the base shell (5), is positioned on the base shell (5) so as to be able to slide next to the latch segment (7) in the longitudinal direction.

10. The connector according to claim 9, characterized in that the one-piece base shell (5) is made of metal.

11. The connector according to claim 9 or 10, characterized in that the base shell (5) is sealed on its inner end in the plug (1) with an inner first O-ring and is sealed on its outer free end, which extends out from the latch segment (7), with a second O-ring (21) that lies in a circumferential groove (22) of the second connector element.

* * * * *